US008899365B2

(12) United States Patent
Nishimura

(10) Patent No.: US 8,899,365 B2
(45) Date of Patent: Dec. 2, 2014

(54) HYDRAULIC EXCAVATOR

(71) Applicant: Komatsu Ltd., Tokyo (JP)

(72) Inventor: Minetaka Nishimura, Hirakata (JP)

(73) Assignee: Komatsu Ltd., Tokyo (JP)

( * ) Notice: Subject to any disclaimer, the term of this patent is extended or adjusted under 35 U.S.C. 154(b) by 0 days.

(21) Appl. No.: 13/991,813

(22) PCT Filed: Nov. 13, 2012

(86) PCT No.: PCT/JP2012/079386

§ 371 (c)(1),
(2), (4) Date: Jun. 5, 2013

(87) PCT Pub. No.: WO2014/076764

PCT Pub. Date: May 22, 2014

(65) Prior Publication Data

US 2014/0133945 A1 May 15, 2014

(51) Int. Cl.

| | |
|---|---|
| ***E02F 9/26*** | (2006.01) |
| ***E02F 9/08*** | (2006.01) |
| ***E02F 9/24*** | (2006.01) |

(52) U.S. Cl.

CPC ..... *E02F 9/0858* (2013.01); *E02F 9/24* (2013.01)

USPC ..... 180/89.13; 37/348

(58) Field of Classification Search

CPC ..... E02F 1/00; E02F 3/00; E02F 5/00; E02F 9/00; E02F 9/264; E02F 9/267; H01Q 1/3275

USPC ..... 280/89.13; 37/347, 379, 381, 443

See application file for complete search history.

(56) References Cited

U.S. PATENT DOCUMENTS

| | | | | |
|---|---|---|---|---|
| 7,780,213 | B2 * | 8/2010 | Kim | 296/37.6 |
| 2004/0148815 | A1 * | 8/2004 | Chikaishi et al. | 37/347 |
| 2005/0210718 | A1 * | 9/2005 | Ueda et al. | 37/466 |
| 2009/0049718 | A1 * | 2/2009 | Tanaka | 37/443 |
| 2009/0084004 | A1 * | 4/2009 | Kim | 37/466 |
| 2010/0034421 | A1 * | 2/2010 | Roberts et al. | 382/100 |
| 2010/0206927 | A1 * | 8/2010 | Noda et al. | 224/401 |
| 2012/0068432 | A1 * | 3/2012 | Tanaka et al. | 280/163 |
| 2012/0325568 | A1 | 12/2012 | Takeo | |
| 2013/0166143 | A1 | 6/2013 | Seki | |

FOREIGN PATENT DOCUMENTS

| | | | |
|---|---|---|---|
| CN | 102648145 | A | 8/2012 |
| JP | 2002322676 | A * | 11/2002 |
| JP | 2007-327190 | A | 12/2007 |
| JP | 2008-102097 | A | 5/2008 |
| WO | 2012/128199 | A1 | 9/2012 |

OTHER PUBLICATIONS

The Chinese Office Action for the corresponding Chinese application No. 201280006567.9, issued on Oct. 13, 2014.

* cited by examiner

*Primary Examiner* — Faye M Fleming
*Assistant Examiner* — Darlene P Condra
(74) *Attorney, Agent, or Firm* — Global IP Counselors, LLP

(57) ABSTRACT

A hydraulic excavator basically includes a lower traveling unit, an upper revolving unit, a counterweight, a machine compartment, a first handrail, a second handrail and a pair of antenna supporting parts. The upper revolving unit is revolvably mounted on the lower traveling unit. The counterweight is disposed on the upper revolving unit. The machine compartment is disposed in front of the counterweight on the upper revolving unit. The first and second handrails are disposed on the machine compartment. The antenna supporting parts are configured to support a pair of antennas. The antenna supporting parts are respectively connected to the first and second handrails.

10 Claims, 6 Drawing Sheets

HYDRAULIC EXCAVATOR

CROSS-REFERENCE TO RELATED APPLICATIONS

This application is a U.S. National stage application of International Application No. PCT/JP2012/079386, filed Nov. 13, 2012.

BACKGROUND

1. Field of the Invention

The present invention relates to a hydraulic excavator that can be equipped with a GNSS antenna.

2. Background Information

A hydraulic excavator equipped with a pair of antennas for a Real Time Kinematic-Global Navigation Satellite System (RTK-GNSS) is known in the prior art (e.g., see Japanese Patent Laid-Open No. 2008-102097). The antennas are mounted on pole-like antenna supporting parts that stand on a counterweight provided at the rear edge of an upper revolving unit.

SUMMARY

Antennas are regularly attached and detached from the antenna supporting parts. However, operability for attaching and detaching the antennas is difficult since the antenna supporting parts are located at the rear edge of the upper revolving unit.

An object of the present invention is to provide a hydraulic excavator that allows for improved operability when attaching and detaching antennas. A hydraulic excavator according to a first aspect of the present invention comprises a lower traveling unit, an upper revolving unit, a counterweight, a machine compartment, a first handrail and a second handrail, and a pair of antenna supporting parts for supporting a pair of antennas. The upper revolving unit is revolvably mounted on the lower traveling unit. The counterweight is disposed on the upper revolving unit. The machine compartment is disposed in front of the counterweight on the upper revolving unit. The first handrail and the second handrail are disposed on the machine compartment. The pair of antenna supporting parts is respectively connected to the first handrail and the second handrail.

According to the hydraulic excavator of the first aspect of the present invention, an operator can stabilize his posture by grasping the first handrail and the second handrail. Therefore, operability for attaching and detaching the pair of antennas can be improved.

A hydraulic excavator according to a second aspect of the present invention is related to the first embodiment, wherein upper ends of the pair of antenna supporting parts are the same height as upper ends of the first handrail and the second handrail, or are higher than the upper ends of the first handrail and the second handrail.

According to the hydraulic excavator of the second aspect of the present invention, the antennas are able to receive radio waves without being obstructed by the first handrail or the second handrail.

The hydraulic excavator according to a third aspect of the present invention is related to the second embodiment, further comprises the pair of antennas is removably attached to the pair of antenna supporting parts. The upper ends of the pair of antenna supporting parts are higher than the upper ends of the first handrail and the second handrail.

According to the hydraulic excavator of the third aspect of the present invention, the pair of antennas is able to receive radio waves without being obstructed by the first handrail or the second handrail.

The hydraulic excavator according to a fourth aspect of the present invention is related to the first to third aspects, wherein the first and second handrails are disposed on the left and right in relation to a center line in the left-right direction.

According to the hydraulic excavator of the fourth aspect of the present invention, the pair of antennas are disposed away from each other to the right and left relative to the center line. As a result, the positional coordinates of the hydraulic excavator can be calculated with high precision on the basis of position information of the pair of antennas.

The hydraulic excavator according to a fifth aspect of the present invention is related to the first to fourth embodiments, and further comprises a passage formed on the machine compartment. The pair of antenna supporting parts is located on an opposite side of the passage relative to the pair of handrails when viewed from above.

According to the hydraulic excavator of the fifth aspect of the present invention, an operator can recognize that the pair of antenna supporting parts is not a handrail. Therefore, there is no need to improve the strength of the pair of antenna supporting parts as much as the handrails.

A hydraulic excavator according to a sixth aspect of the present invention is related to the first to fifth embodiments, and the machine compartment includes an engine compartment disposed in front of the counterweight and an equipment compartment disposed in front of the engine compartment. The first handrail and the second handrail are disposed on the equipment compartment.

According to the hydraulic excavator of the sixth aspect of the present invention, in comparison to a case in which the first and second handrails are formed on the engine compartment, the pair of antennas can be disposed closer to the center of rotation of the upper revolving unit. As a result, the positional coordinates of the hydraulic excavator can be calculated with high precision on the basis of position information of the pair of antennas.

According to the present invention, a hydraulic excavator can be provided that allows for improved operability when attaching and detaching the antenna.

BRIEF DESCRIPTION OF DRAWINGS

Referring now to the attached drawings, which form a part of this original disclosure, the drawings will be briefly described.

DETAILED DESCRIPTION OF EMBODIMENTS

Figure 1:
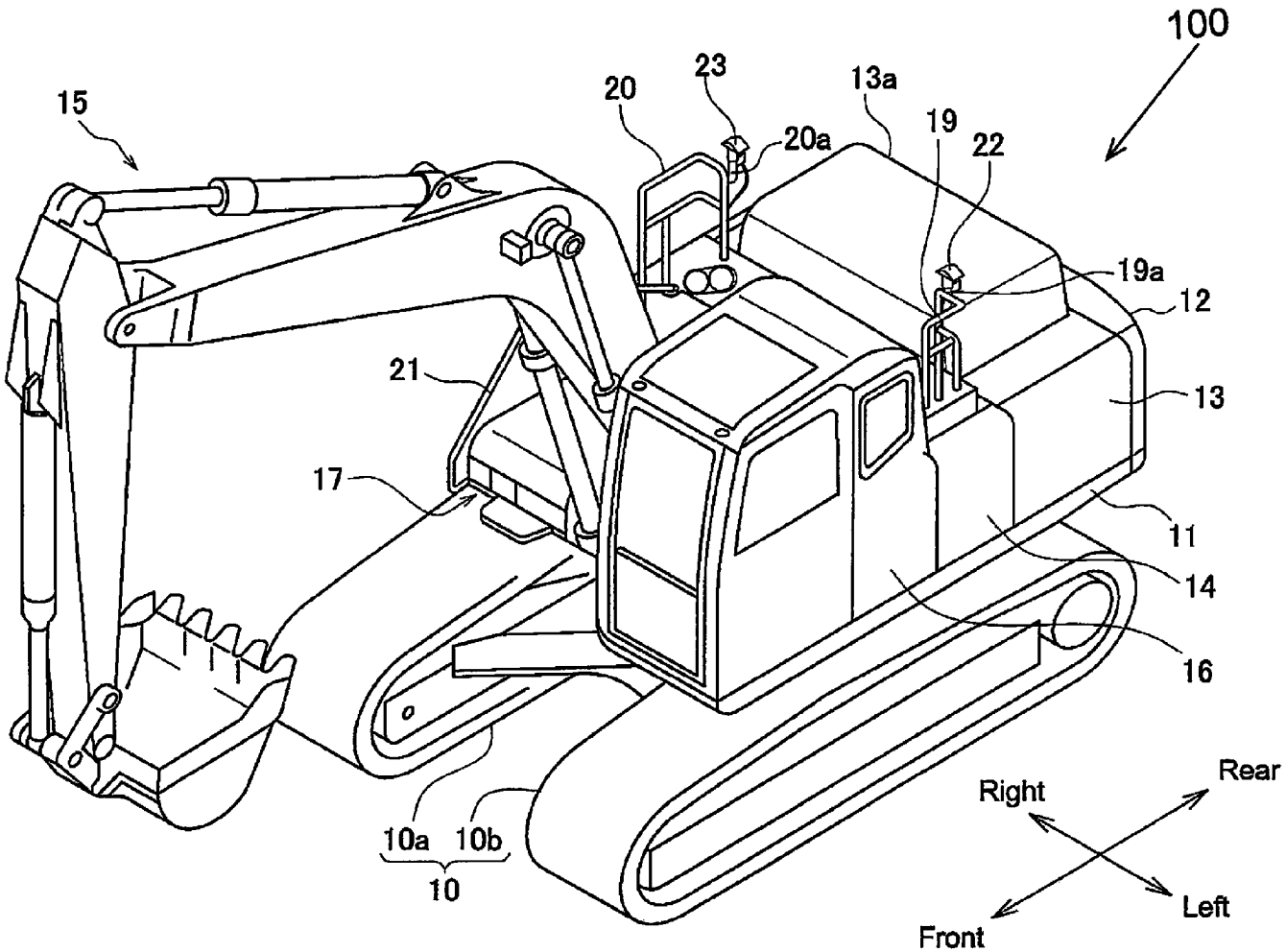
FIG. 1 is a front perspective view of a hydraulic excavator.

Next, embodiments of the present invention will be explained with reference to the drawings. In the following description of the drawings, identical or similar parts are given identical or similar reference numerals. However, the drawings are schematic and dimensional ratios and the like may differ from the actual objects. Therefore, detailed dimensions and the like should be determined in consideration of the following drawings. Moreover, it is needless to say that parts with mutually different dimensional relationships or ratios are included in the drawings.

In the following description, "up," "down," "front," "rear," "left," and "right" are terms used on the basis of an operator sitting in an operator's seat.

Figure 2:
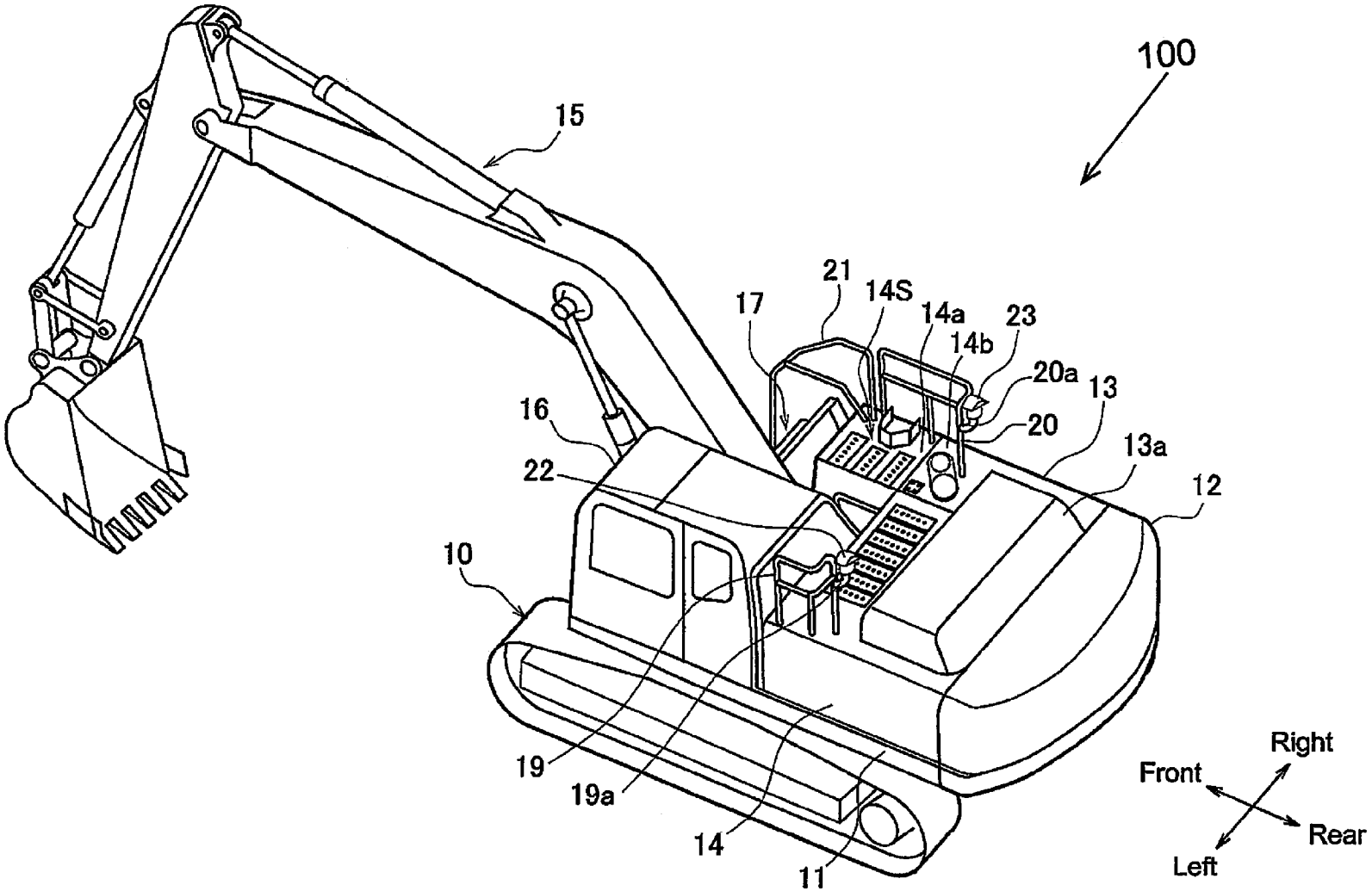
FIG. 2 is a rear perspective view of the hydraulic excavator.

A configuration of a hydraulic excavator 100 according to an embodiment shall be explained in detail with reference to the drawings. FIG. 1 is a front perspective view of the hydraulic excavator 100. FIG. 2 is a rear perspective view of the hydraulic excavator 100.

The hydraulic excavator 100 includes a lower traveling unit 10, an upper revolving unit 11, a counterweight 12, an engine compartment 13, an equipment compartment 14, work implement 15, a cab 16, a steps 17, a first handrail 19, a second handrail 20, a third handrail 21, a first GNSS antenna 22, and a second GNSS antenna 23.

The lower traveling unit 10 includes a pair of rotatable crawlers 10*a*, 10*b* that can rotate independent of each other. The hydraulic excavator 100 runs back and forth and left and right by rotating the pair of crawlers 10*a*, 10*b*.

The upper revolving unit 11 is mounted in a rotatable manner on the lower traveling unit 10. The upper revolving unit 11 is able to rotate around a center of rotation CP (see FIG. 3) that is parallel to the vertical direction. The upper revolving unit 11 constitutes the vehicle body frame of the hydraulic excavator 100. The counterweight 12, the equipment compartment 14, the engine compartment 13, and the cab 16 are disposed on the upper revolving unit 11

The counterweight 12 is arranged to the rear of the engine compartment 13. The counterweight 12 is formed by inserting waste steel or concrete into a box assembled from steel plates. The counterweight 12 is used to maintain balance while doing excavation work and the like.

The engine compartment 13 is disposed on the upper revolving unit 11. The engine compartment 13 is disposed in front of the counterweight 12. The engine compartment 13 is disposed behind the equipment compartment 14. The engine compartment 13 accommodates an engine and an exhaust gas treatment device and the like that are not illustrated in the drawings. An engine hood 13*a* that can be opened and closed is disposed above the engine compartment 13. The operator can stand on a passage 18 and open the engine hood 13*a* when conducting maintenance inside the engine compartment 13.

The equipment compartment 14 is disposed between the engine compartment 13 and the work implement 15 and the cab 16 on the upper revolving unit 11. The equipment compartment 14 includes a fuel tank 14*a* and an operating fluid tank 14*b*. In the present embodiment, an upper surface 14S of the equipment compartment 14 is formed in an L shape as illustrated in FIG. 2.

In the present embodiment, the engine compartment 13 and the equipment compartment 14 constitute a "machine compartment" disposed in front of the counterweight 12.

The work implement 15 is mounted in a swingable manner on the upper revolving unit 11. The work implement 15 is disposed in front of the equipment compartment 14. The work implement 15 is supported by the upper revolving unit 11 between the cab 16 and the steps 17.

The cab 16 is disposed on the upper revolving unit 11. The cab 16 is provided in front of the equipment compartment 14 and to the left of the work implement 15 to allow the operator to view the movement of the work implement 15. An operator's seat in which the operator sits is provided inside the cab 16.

The steps 17 are disposed at the front right of the equipment compartment 14. The steps 17 are used for ascending and descending between ground and the passage 18.

The passage 18 is formed on the equipment compartment 14. The passage 18 is a substantially flat area of the upper surface 14S of the equipment compartment 14. In other words, the passage 18 is an area where the operator can place his feet on the upper surface 14S of the equipment compartment 14. The passage 18 according to the present embodiment is formed in an L shape in accordance with the shape of the upper surface 14S of the equipment compartment 14. A non-slip treatment is applied to the surface of the passage 18. Specifically, a plurality of half-spherical protrusions is formed on the surface of the passage 18. The non-slip treatment may be formed on the entire surface of the passage 18.

The first and second handrails 19, 20 are disposed on the equipment compartment 14. The first and second handrails 19, 20 are provided at the edges of the passage 18 and are used by the operator standing on the passage 18 to support his body. The first handrail 19 and the second handrail 20 are separated from each other in the left-right direction. Thus, the operator standing between the first handrail 19 and the second handrail 20 is able to open the engine hood 13*a* to conduct maintenance inside the engine compartment 13.

In the present embodiment, both the first and second handrails 19, 20 are formed in an L shape when viewed from above. Specifically, one side of each L shape extends along the left and right side edges of the upper revolving unit 11, and the other side of each L shape extends from the end of the one side toward the inside of the upper revolving unit 11. The installation location and configuration of the first and second handrails 19, 20 are explained below.

A first antenna supporting part 19*a* is connected to the first handrail 19. The first antenna supporting part 19*a* is a bracket for attaching the first GNSS antenna 22. Similarly, a second antenna supporting part 20*a* is connected to the second handrail 20. The second antenna supporting part 20*a* is a bracket for attaching the second GNSS antenna 23. The installation location and configuration of the first and second antenna supporting parts 19*a*, 20*a* are explained below.

The third handrail 21 is disposed in front of the first handrail 19 and to the right of the steps 17. The third handrail 21 is used by the operator when ascending or descending the steps 17 to support his body.

The first and second GNSS antennas 22, 23 are antennas used for a Real Time Kinematic-Global Navigation Satellite System (RTK-GNSS). The first and second GNSS antennas 22, 23 are disposed above the passage 18. The first GNSS antenna 22 is attached to the first antenna supporting part 19*b* on the first handrail 19. The second GNSS antenna 22 is attached to the second antenna supporting part 20*b* on the second handrail 20.

Figure 3:
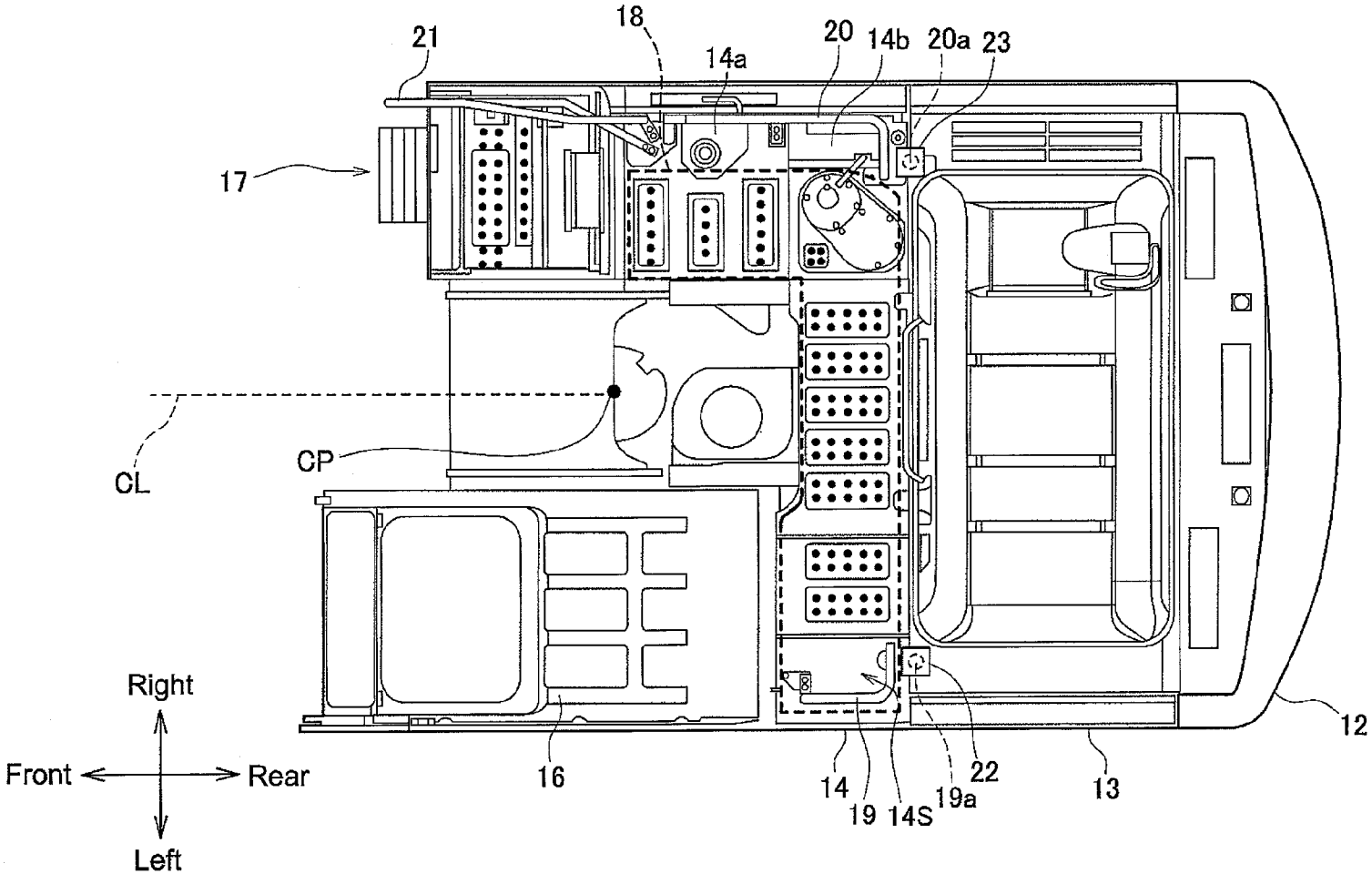
FIG. 3 is a top view of an equipment compartment.
Figure 4:
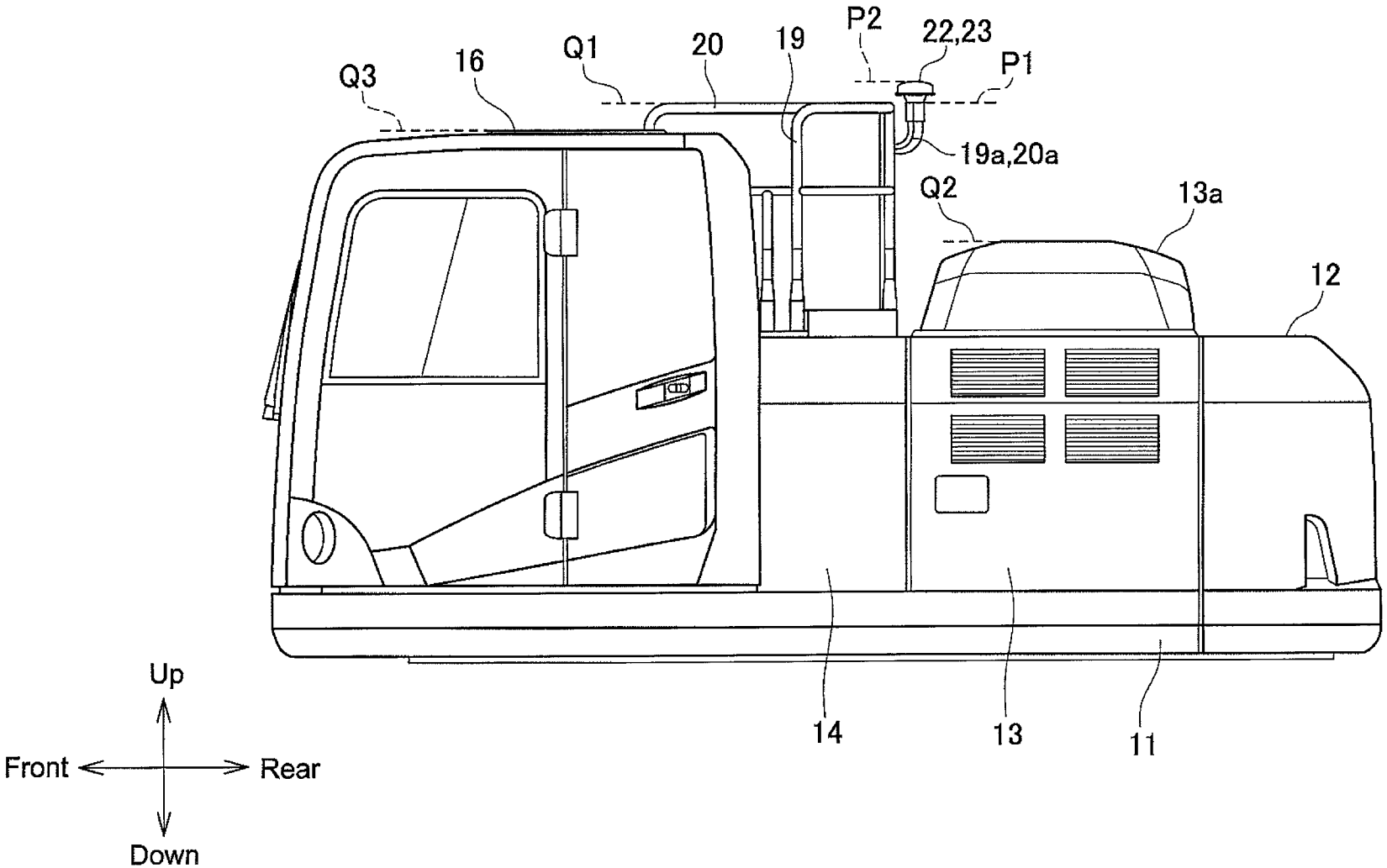
FIG. 4 is a side view of the equipment compartment.

Next, the installation location of first and second antenna supporting parts 19*a*, 20*a* is explained with reference to the drawings. FIG. 3 is a top view of the upper revolving unit 11 and illustrates the equipment compartment 14 and the like. FIG. 4 is a side view of the upper revolving unit 11 and illustrates the equipment compartment 14 and the like.

First, the installation location of first and second handrails 19, 20 is explained with reference to FIG. 3.

The first and second handrails 19, 20 are provided at the edge of the passage 18 and are disposed above the equipment compartment 14. The first and second handrails 19, 20 are separated from each other to the left and right relative to a center line CL in the left-right direction of the hydraulic excavator 100. The first handrail 19 is disposed on the left end of the equipment compartment 14. The first handrail 19 covers the left side of the passage 18. The second handrail 20 is disposed on the right end of the equipment compartment 14. Specifically, the second handrail 20 is disposed so as to straddle the fuel tank 14*a* and the operating fluid tank 14*b*. The second handrail 20 covers the right side of the passage 18.

Next, the installation location of the first and second antenna supporting parts 19*a*, 20*a* is explained with reference to FIG. 3.

The first and second antenna supporting parts 19*a*, 20*a* are respectively connected to the first and second handrails 19, 20. The first and second antenna supporting parts 19*a*, 20*a* are disposed to the right and left relative to the center line CL. In the present embodiment, the first and second antenna supporting parts 19*a*, 20*a* are located symmetrically on the right and left of the center line CL.

The first and second antenna supporting parts 19*a*, 20*a* are respectively located to the rear of the first and second handrails 19, 20. The first and second antenna supporting parts 19*a*, 20*a* are located to the rear of the passage 18. In the present embodiment, the first and second antenna supporting parts 19*a*, 20*a* are located on a boundary line between the engine compartment 13 and the equipment compartment 14. In other words, the first and second antenna supporting parts 19*a*, 20*a* are provided on opposite side of the passage 18 relative to the first and second handrails 19, 20.

Since the first and second GNSS antennas 22, 23 are respectively attached to the first and second antenna supporting parts 19*a*, 20*a*, the disposition locations of the first and second GNSS antennas 22, 23 are similar to the disposition locations of the abovementioned first and second antenna supporting parts 19*a*, 20*a*.

As illustrated in FIG. 4, the first and second antenna supporting parts 19*a*, 20*a* are respectively connected to rear parts of the first and second handrails 19, 20. The first and second antenna supporting parts 19*a*, 20*a* extend diagonally upward and to the rear from the positions where the first and second antenna supporting parts 19*a*, 20*a* are respectively connected to the first and second handrails 19, 20.

A supporting part upper end position P1 that indicates a position in the vertical direction of the upper ends of the first and second antenna supporting parts 19*a*, 20*a* is substantially the same height as a handrail upper end position Q1 that indicates a position in the vertical direction of the upper ends of the first and second handrails 19, 20. The supporting part upper end position P1 is higher than a hood upper end position Q2 that indicates a position in the vertical direction of the upper end of the engine hood 13*a*. Further, the supporting part upper end position P1 is higher than a cab upper end position Q3 that indicates a position in the vertical direction of the upper end of the cab 16.

The first and second GNSS antennas 22, 23 are preferably disposed in a location higher than the upper end of the cab 16 in order to properly receive GNSS satellite radio waves.

The first and second GNSS antennas 22, 23 are disposed on the first and second antenna supporting parts 19*a*, 20*a*. As a result, an antenna upper end position P2 that indicates a position in the vertical direction of the upper end of the first and second GNSS antenna 22, 23 is higher than the supporting part upper end position P1. Therefore, the antenna upper end position P2 is higher than the hood upper end position Q2 and the cab upper end position Q3.

Next, the configuration of the first and second antenna supporting parts 19*a*, 20*a* is explained with reference to the drawings. The following is an explanation of the configuration of the second antenna supporting part 20*a* since the first and second antenna supporting parts 19*a*, 20*a* have the same configuration.

Figure 5:
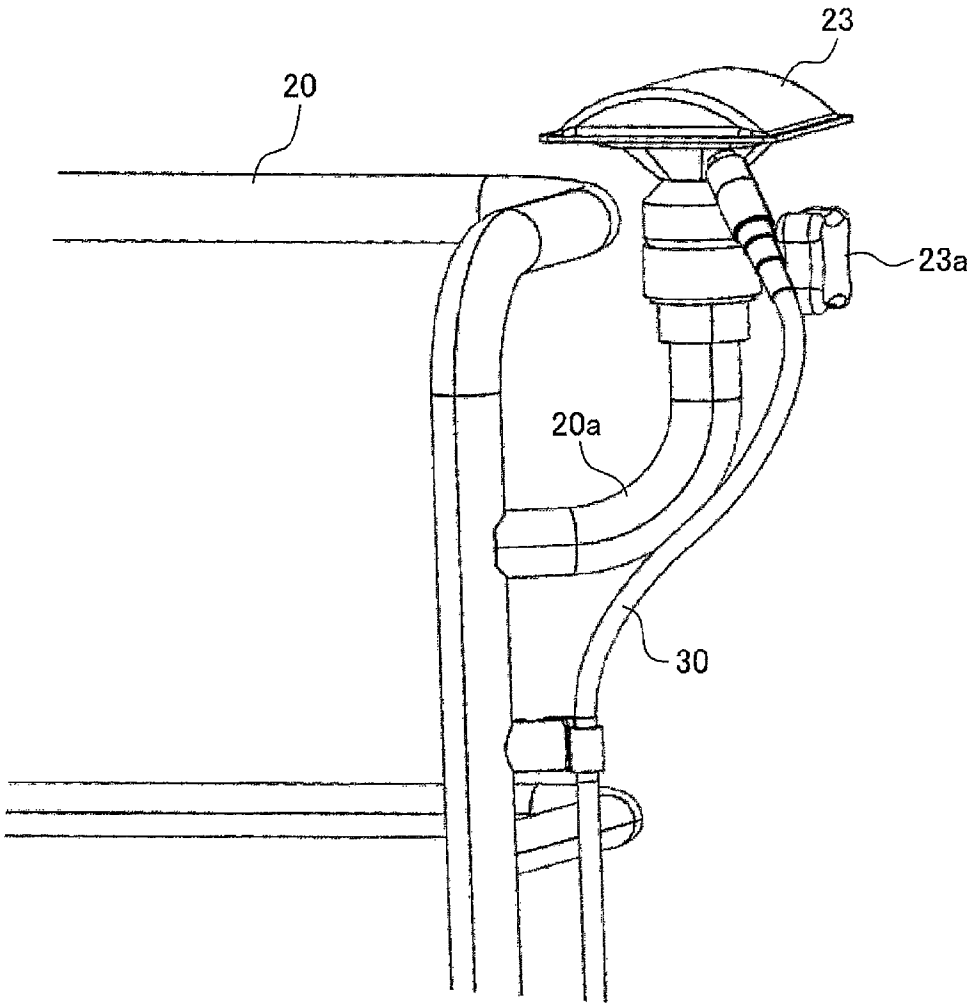
FIG. 5 illustrates a configuration of the pair of antenna supporting parts.
Figure 6:
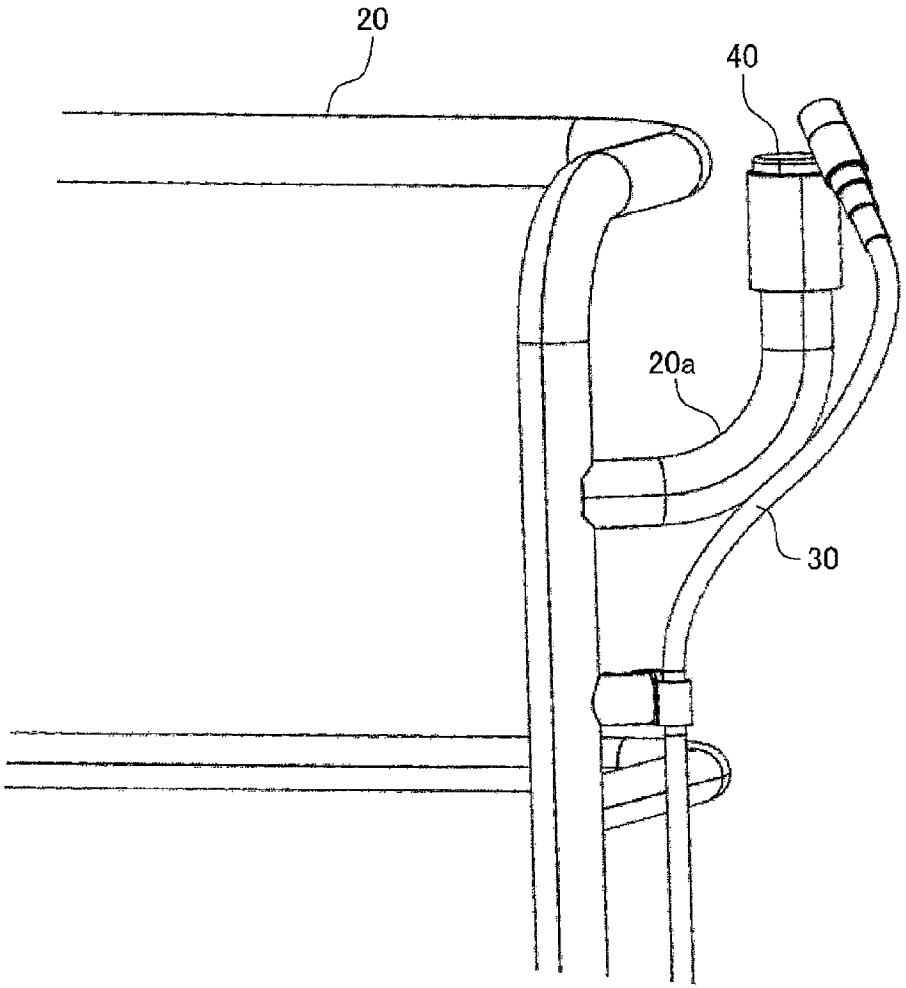
FIG. 6 illustrates a configuration of the pair of antenna supporting parts.

FIG. 4 illustrates a condition in which the second GNSS antenna 23 is attached to the second antenna supporting part 20*a*. FIG. 5 illustrates a condition in which the second GNSS antenna 23 is detached from the second antenna supporting part 20*a*.

The second antenna supporting part 20*a* is a bracket configured by a circular pipe bent into an L shape as illustrated in FIG. 4. The second antenna supporting part 20*a* is disposed to extend backward and upward from the rear part of the second handrail 20. The second GNSS antenna 23 disposed on the second antenna supporting part 20*a* has a knob 23*a* for coupling the second GNSS antenna 23 to the second antenna supporting part 20*a*. A cable 30 for transmitting position information to a controller is connected to the second GNSS antenna 23.

As illustrated in FIG. 5, a cap 40 is fitted onto the second antenna supporting part 20*a* when the second GNSS antenna 23 is detached.

(1) In the present embodiment, the first and second antenna supporting parts 19*a*, 20*a* (example of a pair of antennas supporting parts) are respectively connected to the first and second handrails 19, 20.

Consequently, the operator can stabilize his posture by grasping the first and second handrails 19, 20 when attaching or detaching the first and second GNSS antennas 22, 23. Therefore, the operability for attaching and detaching the first and second GNSS antennas 22, 23 is improved.

(2) The supporting part upper end position P1 is substantially the same height as the handrail upper end position Q1. Furthermore, the antenna upper end position P2 is higher than the supporting part upper end position P1.

Consequently, the first and second GNSS antennas 22, 23 can receive GNSS satellite radio waves without being obstructed by the first and second handrails 19, 20.

(3) The first and second antennas 19, 20 are disposed on the right and left relative to the center line CL in the left-right direction.

Therefore, the first and second GNSS antennas 22, 23 are disposed away from each other in the left and right directions relative to the center line CL. As a result, the positional coordinates of the hydraulic excavator can be calculated with high precision on the basis of position information of the first and second GNSS antennas 22, 23.

(4) The first and second antenna supporting parts 19*a*, 20*a* are located on opposite side of the passage 18 relative to the first and second handrails 19, 20.

Therefore, the operator can recognize that the first and second antenna supporting parts 19*a*, 20*a* are not handrails. Thus, there is no need to improve the strength of the first and second antenna supporting parts 19*a*, 20*a* as much as the handrails.

(5) The first and second handrails 19, 20 are formed on the equipment compartment 14.

Therefore, the first and second GNSS antennas 22, 23 can be located closer to the center of rotation of the upper revolving unit 11 than a case in which the first and second handrails 19, 20 are formed on the engine compartment 13. As a result, the positional coordinates of the hydraulic excavator can be calculated with high precision on the basis of position information of the first and second GNSS antennas 22, 23.

While the present invention has been described with the embodiment provided above, the description and drawings form a portion of the disclosure and are not to be understood as limiting the invention. Various substitutions, embodiments, and operation techniques will be apparent to those skilled in the art.

(A) While the first and second antenna supporting parts 19*a*, 20*a* are disposed on the equipment compartment 14 in the above embodiment, the present invention is not limited as such. The first and second handrails 19, 20 may be disposed on the "machine compartment" disposed in front of the counterweight 12. Therefore, the first and second handrails 19, 20 may be disposed on the engine compartment 13, or may be disposed straddling both the engine compartment 13 and the equipment compartment 14.

(B) While the supporting part upper end position P1 is substantially the same height as the handrail upper end position Q1 in the above embodiment, the present invention is not limited as such. The supporting part upper end position P1 may be higher than the handrail upper end position Q1. While the supporting part upper end position P1 may also be lower than the handrail upper end position Q1, in this case the antenna upper end position P2 is preferably higher than the supporting part upper end position P1.

(C) While the first and second antenna supporting parts 19*a*, 20*a* are located respectively to the rear of the first and second handrails 19, 20 in the above embodiment, the present invention is not limited as such. The first and second antenna supporting parts 19*a*, 20*a* may be respectively located in front of or beside the first and second handrails 19, 20.

(D) While the first and second antenna supporting parts 19*a*, 20*a* are located on the boundary line between the engine compartment 13 and the equipment compartment 14 in the above embodiment, the present invention is not limited as such. The first and second antenna supporting parts 19*a*, 20*a* may be disposed on the engine compartment 13 or disposed on the equipment compartment 14.

As described above, it is a matter of course that the present invention incorporates a variety of preferred embodiments which are not described herein. Hence the technical scope of the present invention is defined only by matters to define the invention, which are according to the scope of claims, reasonable from the above description.

The present invention is useful in the field of hydraulic excavators since the operability for attaching and detaching antennas can be improved according to the hydraulic excavator of the present invention.

What is claimed is:

1. A hydraulic excavator comprising:

a lower traveling unit;

an upper revolving unit revolvably mounted on the lower traveling unit;

a counterweight disposed on the upper revolving unit;

a machine compartment disposed in front of the counterweight on the upper revolving unit;

a first handrail disposed on the machine compartment;

a second handrail disposed on the machine compartment;

a first antenna supporting part configured to support a first antenna;

a second antenna supporting part configured to support a second antenna, the first antenna supporting part being connected to the first handrail and the second antenna supporting part being connected to the second handrail; and a passage formed on the machine compartment, the first and second antenna supporting parts being located on opposite sides of the passage relative to the first handrail and the second handrail as viewed from above.

2. The hydraulic excavator according to claim 1, wherein the first antenna supporting part has an upper end that is at the same height or higher than an upper end of the first handrail, and the second antenna supporting part has an upper end that is at the same height or higher than an upper end of the second handrail.

3. The hydraulic excavator according to claim 2 further comprising:

the first and second antennas, which are removably attached to the first and second antenna supporting parts;

the first and second antenna have upper ends that are higher than the upper ends of the first handrail and the second handrail, respectively.

4. The hydraulic excavator according to claim 3, wherein the first handrail and the second handrail are disposed on the left and right relative to a longitudinal center line of the hydraulic excavator.

5. The hydraulic excavator according to claim 3, wherein the machine compartment includes an engine compartment disposed in front of the counterweight and an equipment compartment disposed in front of the engine compartment; and the first handrail and the second handrail are disposed on the equipment compartment.

6. The hydraulic excavator according to claim 2, wherein the first handrail and the second handrail are disposed on the left and right relative to a longitudinal center line of the hydraulic excavator.

7. The hydraulic excavator according to claim 2, wherein the machine compartment includes an engine compartment disposed in front of the counterweight and an equipment compartment disposed in front of the engine compartment; and the first handrail and the second handrail are disposed on the equipment compartment.

8. The hydraulic excavator according to claim 1, wherein the first handrail and the second handrail are disposed on the left and right relative to a longitudinal center line of the hydraulic excavator.

9. The hydraulic excavator according to claim 8, wherein the machine compartment includes an engine compartment disposed in front of the counterweight and an equipment compartment disposed in front of the engine compartment; and the first handrail and the second handrail are disposed on the equipment compartment.

10. The hydraulic excavator according to claim 1, wherein the machine compartment includes an engine compartment disposed in front of the counterweight and an equipment compartment disposed in front of the engine compartment; and the first handrail and the second handrail are disposed on the equipment compartment.

* * * * *